US007591691B2

(12) United States Patent
Lappoehn

(10) Patent No.: US 7,591,691 B2
(45) Date of Patent: Sep. 22, 2009

(54) PLUG-IN CONNECTOR

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 14 days.

(21) Appl. No.: 11/765,547

(22) Filed: Jun. 20, 2007

(65) Prior Publication Data

US 2008/0032536 A1 Feb. 7, 2008

(30) Foreign Application Priority Data

Aug. 4, 2006 (DE) ..... 10 2006 036 884

(51) Int. Cl.
*H01R 13/40* (2006.01)

(52) U.S. Cl. ..... 439/733.1

(58) Field of Classification Search ..... 439/310, 439/733.1, 747, 751, 752, 595, 63, 78
See application file for complete search history.

(56) References Cited

U.S. PATENT DOCUMENTS 5,879,200 A * 3/1999 Sugie ..... 439/733.1
6,152,782 A * 11/2000 Volkert et al. ..... 439/733.1
2004/0229519 A1* 11/2004 Lappohn ..... 439/733.1

FOREIGN PATENT DOCUMENTS

| | | | |
|---|---|---|---|
| DE | 2808671 | A1 | 9/1979 |
| DE | 100 15 842 | | 2/2002 |
| DE | 102005024336 | A1 | 12/2005 |
| DE | 102004054535 | | 3/2006 |
| DE | 102005033696 | A1 | 3/2006 |
| EP | 141091 | A2 | 5/1985 |
| EP | 0596338 | | 5/1994 |

* cited by examiner

*Primary Examiner*—Edwin A. Leon
(74) *Attorney, Agent, or Firm*—Collard & Roe, P.C.

(57) ABSTRACT

The invention relates to a plug-in connector (10) having at least one contact chamber (50) provided in a plug housing (12) for receiving a contact element (11) that provides at least one abutment (51, 52) for a locating element (41) arranged on the contact element (11). The locating element (41) is designed as an inelastic locating hook (41). The side wall (30, 31) of the contact chamber (50) is resilient, at least in the area before the abutment (51, 52), Further, a recess (36, 37) is provided in the plug housing (12) at least adjacent the resilient area of the side wall (30, 31).

6 Claims, 4 Drawing Sheets

PLUG-IN CONNECTOR

PRIOR ART

The present invention relates to a plug-in connector according to the preamble of the independent claim.

DE 10 2005 024 336 A1 describes an electric plug-in connector that provides increased extraction or pull-out force for a line connected to the plug-in connector, which force is achieved by a secondary locking element. The secondary locking element is pushed into the locked position, transversely to the plug-in direction, after the contact elements have been mounted in a plug-in connector base element. In its locked position, the secondary locking element engages behind a locking shoulder arranged on each of the contact elements.

A plug-in connector comprising a secondary locking arrangement with strain relief has been described in DE 100 15 842 C1, where a contact element is retained by a spring in a primary locking recess in the mounted condition of the contact element.

With the contact elements mounted in the plug-in connector base element, a secondary locking element is pushed onto the plug-in connector base element transversely to the plug-in direction so that it comes to embrace the plug-in connector base element by both sides. Locking noses formed on both sides of the secondary element extend over the full width of the secondary locking element. In the mounted condition of the secondary locking element, the two locking noses engage behind the rear end of each of the contact elements, viewed in the plug-in direction, thereby securing the contact element from being pulled off the plug-in connector base element unintentionally.

DE 10 2005 033 696 A1 describes a contact element of a plug-in connector that comprises two contact springs arranged within a cuboid section of the contact element as well as two spring tongues arranged on the outer lateral surfaces of the cuboid section. The ends of the spring tongues serve as locating tongues that cause the contact element to snap into place as the contact element is pushed into an enclosing plastic housing not disclosed in more detail.

A contact element designed as a multipoint socket connector comprising a resilient retaining clip designed to engage behind a recess in a contact housing has become known from DE 28 08 671 A1. Once locked in place, the retaining clip used as locating element prevents the contact element from being pulled off or pushed out of the contact housing against the plug-in direction.

The contact element comprises a further resilient retaining clip that urges the connection line against the inner wall of the plug housing in the area of the insulation.

EP 141091 A2 describes a contact element with a penetration terminal for miniaturized electric plugs, having a contact area and a wire clamping area. A penetration terminal in the form of a lug with two protuberances on its free upper edge is bent off from a basic web in the wire clamping area. The penetration terminal exhibits a duplex design consisting of two penetration lugs placed one against the other. A forward edge and a rear edge of the penetration lug are equipped with barb-like teeth that serve to anchor the penetration terminal in a slot—not described in more detail—of a housing not shown.

Now, it is the object of the present invention to provide a plug-in connector with high pull-out force.

That object is achieved by the features defined in the independent claim.

DISCLOSURE OF THE INVENTION

The plug-in connector according to the invention proceeds from at least one contact chamber provided in a plug housing for receiving a contact element that provides at least one abutment for a locating element arranged on the contact element. The locating element is designed as an inelastic locating hook. The side wall of the contact chamber is resilient, at least in the area before the abutment. Further, a recess is provided in the plug housing at least adjacent the resilient area of the side wall.

Compared with the solution known from the prior art, the plug-in connector according to the invention provides considerably increased extraction force or pull-out force that tends to prevent the contact element from being extracted or pulled out of the plug housing unintentionally.

In making the plug-in connection according to the invention, the contact element can be pushed into the plug housing at comparatively low force. The force-saving mounting process reduces the loading on the mounting unit thereby increasing its service life.

The high extraction force and the simple mounting process are the result of a simple structure of the plug-in connector which does not give rise to higher costs, compared with the designs according to the prior art.

This results in considerable cost savings, especially in series production of the plug-in connector according to the invention.

The plug-in connector according to the invention meets high safety demands, as specified for example for plug-in connections in the automobile industry.

The plug-in connector according to the invention is suited for making high-current plug-in connections having increased safety demands with respect to the pull-out force. The plug-in connector according to the invention is especially suited for realizing multipole plug-in connectors with a small number of poles, which still provide the high pull-out force.

Advantageous further developments and embodiments of the plug-in connector according to the invention are obvious from dependent claims.

One embodiment provides that both side walls are resilient, at least in the area before the abutments, and that recesses are provided in the plug housing at least adjacent the resilient area of both side walls. This embodiment leads to a symmetric arrangement, relative to one contact element. That arrangement is suited especially for producing multipole plug-in connectors where a recess is provided in the plug housing between each pair of neighboring contact chambers.

According to one embodiment, locating hooks are provided on both sides of the contact element. With the aid of that feature the pull-out force maximally achievable per contact element of the plug-in connection is obtained.

Another embodiment provides that the side wall comprises at least one tapered portion. In some cases, two tapered portions are provided. It may be provided especially that the at least one tapered portion is provided at the lower and/or the upper end of the side wall. The at least one tapered portion of the side wall contributes toward giving the side wall the desired resilient properties.

According to one embodiment, the edge length of the locating area of the locating hook is determined depending on the predefined pull-out force and/or mounting force. Another embodiment provides that the maximum projection length of the locating hook is determined depending on the predefined pull-out force and/or mounting force. Still another embodiment provides that the angle of inclination of the projection of the hook is determined depending on the predefined pull-out force and/or mounting force.

With the aid of these features it is possible to vary the pull-out force and/or the mounting force within a wide range although it must be considered in this connection that in the presence of firmly defined resilience properties of the side wall the pull-out force and the mounting force will increase similarly.

Certain embodiments of the invention are illustrated in the drawing and will be described hereafter in more detail.

Figure 1:
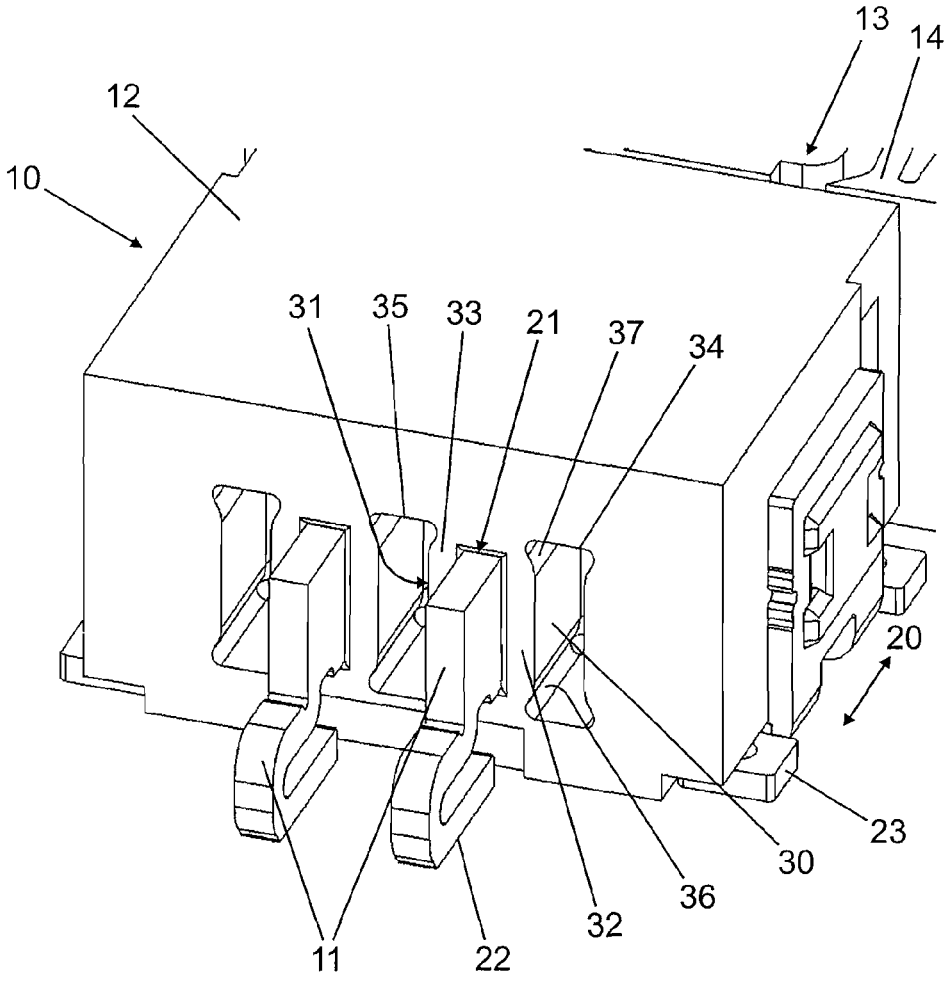
FIG. 1 shows a perspective view of a plug-in connector according to the invention, in mounted condition.

FIG. 1 shows a perspective view of a plug-in connector 10 according to the invention, with components fitted, where at least one contact element 11 is arranged in a plug housing 12. The plug-in connector 10 is further shown in the condition in which it is fitted in a corresponding plug-in connector 13 which latter comprises a corresponding plug housing 14.

During the fitting operation, the contact element 11 is pushed 20 through a contact element opening 21 of the plug housing 12 in the fitting direction. For fitting it is likewise possible to push the plug housing 12 onto the at least one contact element 11. This is why the fitting direction 20 is indicated by two-sided arrows in FIG. 1. In the example illustrated in FIG. 1, the fitting direction 20 further corresponds to the plug-in direction of the plug-in connection that comprises the two plug-in connectors 10, 13.

The contact element 11 comprises a solder terminal 22, implemented preferably as SMD solder terminal 22. The solder terminal 22 can be soldered to a board not illustrated in FIG. 1, on which the plug housing 12 of the plug-in connector 10 can likewise be fixed by soldering or screwing via a mounting element 23.

The contact element 11 is arranged in the plug housing 12 in a contact chamber not visible in FIG. 1, the chamber being laterally delimited by a first and a second side wall 30, 31. The side walls 30, 31 are each provided with end faces 32, 33 in the area of the contact element opening 21.

The first side wall 30 is arranged adjacent a first recess 34 provided in the plug housing 12, while the second side wall 31 is arranged adjacent a second recess 35.

The at least one side wall 30, 31 is resilient. The resilient property of the side wall 30, 31 is influenced selectively by at least one tapered portion 36, 37. The at least one tapered portion preferably is provided at the lower/upper end of the side wall 30, 31. Preferably, tapered portions are provided at both the lower and the upper ends of the side wall 30, 31 for allowing the resilient properties of the at least one side wall 30, 31 to be made symmetrical.

If two side walls 30, 31 adjoin one recess 34, 35 and if tapered portions 36, 37 are provided on both the lower and the upper ends of the side walls 30, 31, then the recesses 34, 35 have a bone-like cross-section.

Figure 2:
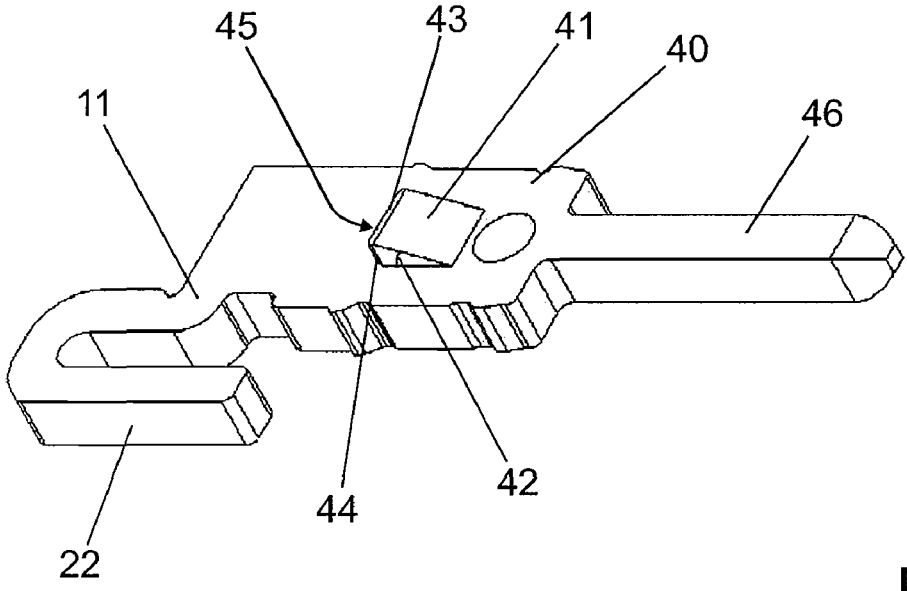
FIG. 2 shows a perspective view of a contact element with a locating hook.

FIG. 2 shows a perspective view of the contact element 11, where parts identical to those of FIG. 1 are indicated by the same reference numerals as in FIG. 1.

A locating hook 41, which preferably is formed from the contact element 11 by punching, is provided on at least one lateral surface 40 of the contact element 11. Punching allows the locating hook 41 to be produced at especially low cost.

The angle of inclination 42, the edge length 43 and the projection length 44 can be determined during the operation of making the locating hook 41. The edge length 43 and the projection 44 define the locating area 45 of the locating hook 41 that coacts with a locating area of an abutment illustrated in FIG. 3, which will be described hereafter.

In the embodiment illustrated in FIG. 2, the contact element 11 is equipped with a multipoint pin contact 46.

Figure 3:
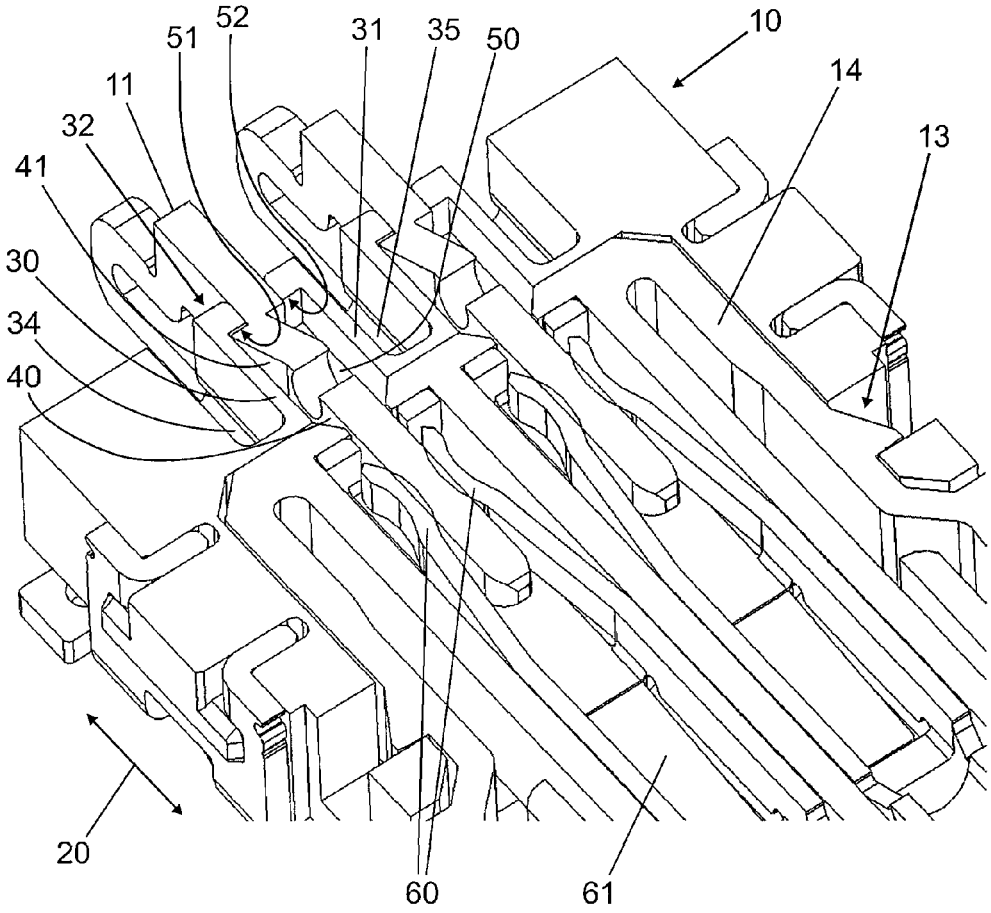
FIG. 3 shows a sectioned perspective view of a plug-in connector according to the invention in mounted condition, viewed in the direction of an abutment.

FIG. 3 shows a perspective cross-section through the plug-in connector 10 according to the invention with components fitted and in the plugged-in condition. Those parts of FIG. 3 that correspond to the parts illustrated in the preceding Figures are indicated by the same reference numerals.

In the mounted condition, the at least one contact element 11 is arranged in a contact chamber 50. The locating hook 41 has passed the end face 32 of the first side wall 30 and has snapped into place. In the snapped-in condition, the locating area 45 of the locating hook 41 rests on the locating area of an abutment 51, 52.

For purposes of the illustrated embodiment it has been assumed that the projection length 44 of the locating hook 41 corresponds to the locating area of the abutment 51, 52 that matches the projection 44. Further, it has been assumed for purposes of the illustrated embodiment that a locating hook 41 is provided on the contact element 11 only on one lateral surface 40.

The locating hook 41 is inelastic. To be inelastic means that the locating hook 41 has no or only slight resilient properties. During the mounting operation, the locating hook 41 must be capable at least of applying the mounting force necessary to push the end face 32, 33 of the at least one side wall 30, 31, and the at least one side wall 30, 31 far enough to the outside and into the neighboring recess 34, 35 as to permit the locating hook 41 to be introduced through the contact element 41 and to be pushed forward in the mounting direction 30 a sufficient distance to permit the locating area 45 of the locating hook 41 to reach the corresponding locating area of the abutment 51, 52.

When the rear end of the locating area of the locating hook 41 passes the corresponding locating area of the abutment 51, 52, the locating hook 41 will snap into the abutment 51, 52.

As has been mentioned before, the term "before the abutment" relates to the mounting direction 20 and corresponds to that area of the side wall 30, 31 along which the locating hook 41 slides during the mounting operation, thereby bending the side wall 30, 31 in outward direction before the locating hook 41 reaches the abutment 51, 52. According to one embodiment, a larger portion or even the entire side wall 30, 31 may be made resilient.

FIG. 3 shows a plug-in connector 10 in the plugged-in condition with the matching plug-in connector 13. The multipoint pin contact 46 of the contact element 11 coacts with a corresponding multipoint slot contact 60 of the corresponding contact element 61.

Figure 4:
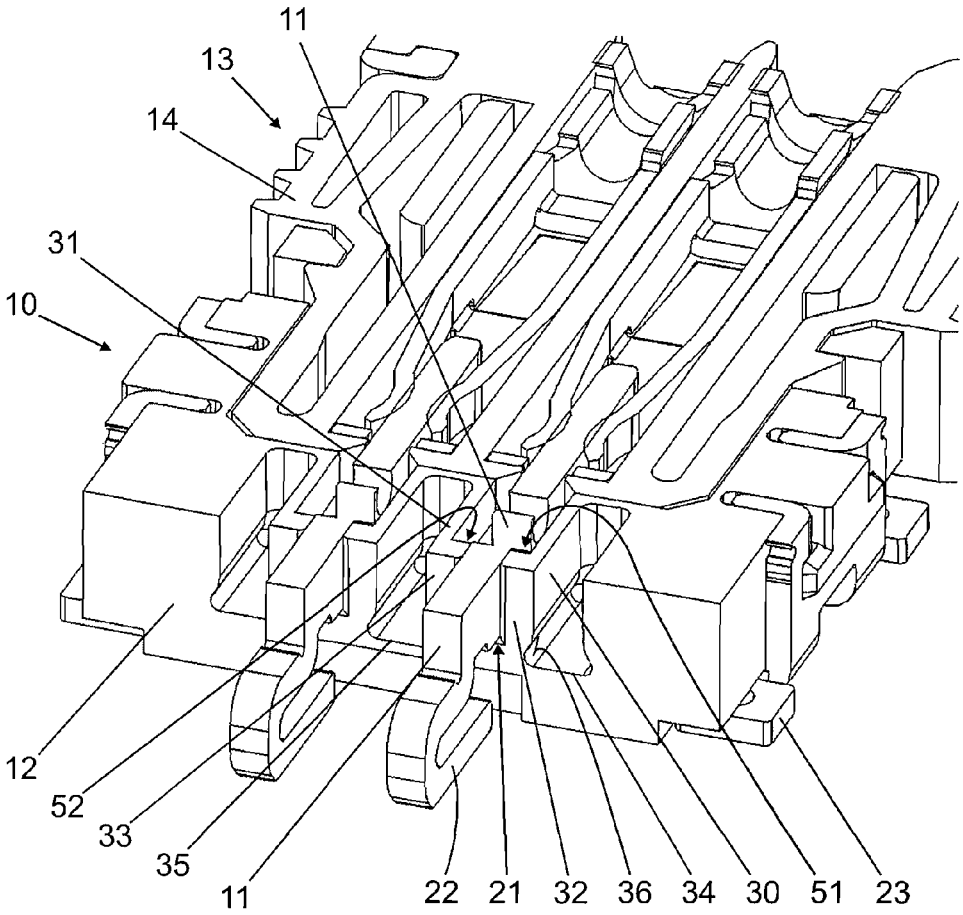
FIG. 4 shows a sectioned perspective view of a plug-in connector according to the invention in mounted condition, viewed from a different perspective.

FIG. 4 shows a sectioned perspective view of a plug-in connector 10 according to the invention, in mounted condition and in plugged-in condition, viewed from a different perspective where the end face 32, 33 of the at least one side wall 30, 31 is freely visible.

The invention claimed is:

1. Plug-in connector comprising at least one contact chamber provided in a plug housing for receiving a contact element that provides at least one abutment for a locating element arranged on the contact element, wherein the locating element is designed as an inelastic locating hook, a side wall of the contact chamber is resilient, at least in the area before the abutment, a recess is provided in the plug housing at least adjacent the resilient area of the side wall, the recess comprising an outwardly open hollow opening defined in part by the side wall of the contact chamber, by a first tapered portion provided at a lower end of the side wall and by a second tapered portion provided at an upper end of the side wall, wherein the first tapered portion and the second tapered portion selectively and symmetrically influence the resiliency of the side wall and wherein the resilient area of the side wall is displaced into the recess during a mounting of the contact element into the contact chamber.

2. The plug-in connector as defined in claim 1, wherein said side wall comprises a first side wall and a second side wall, wherein said first side wall and said second side wall are resilient, at least in the area before the abutments, and wherein said recess comprises a first recess provided in the plug housing at least adjacent the resilient area of said first side wall and a second recess provided in the plug housing at least adjacent the resilient area of said second side wall.

3. The plug-in connector as defined in claim 1, wherein locating hooks are provided on both sides of the contact element.

4. The plug-in connector as defined in claim 1, wherein an edge length of a locating area of the locating hook is determined depending on a predefined pull-out force and/or mounting force.

5. The plug-in connector as defined in claim 1, wherein a maximum projection length of the locating hook is determined depending on a predefined pull-out force and/or mounting force.

6. The plug-in connector as defined in claim 1, wherein an angle of inclination of a projection of the locating hook is determined depending on a predefined pull-out force and/or mounting force.

* * * * *